United States Patent [19]

Branders

[11] Patent Number: 4,758,154

[45] Date of Patent: Jul. 19, 1988

[54] FLUIDIZED-BED PLANT

[75] Inventor: Franz Branders, Koekelberg, Belgium

[73] Assignee: Le Four Industriel Belge, Brussels, Belgium

[21] Appl. No.: 885,644

[22] Filed: Jul. 15, 1986

[30] Foreign Application Priority Data

Jul. 15, 1985 [LU] Luxembourg ..... 86008

[51] Int. Cl.[4] ..... F27B 19/00

[52] U.S. Cl. ..... 432/58; 34/57 A

[58] Field of Search ..... 432/58; 34/57 A, 57 R; 110/245; 239/558, 567; 122/5 D

[56] References Cited

U.S. PATENT DOCUMENTS

| | | | |
|---|---|---|---|
| 4,223,843 | 9/1980 | Smith et al. | 34/57 A |
| 4,578,879 | 4/1986 | Yokoyama et al. | 34/57 A |

FOREIGN PATENT DOCUMENTS

| | | | |
|---|---|---|---|
| 48311 | 11/1983 | German Democratic Rep. | 34/57 R |
| 44-31693 | 12/1969 | Japan . | |
| 44-17614 | 1/1970 | Japan . | |
| 4266772 | 2/1971 | Japan . | |
| 46-6691 | 2/1971 | Japan . | |
| 46-18842 | 5/1971 | Japan . | |
| 46-33369 | 9/1971 | Japan . | |
| 5655237 | 7/1975 | Japan . | |
| 53-571 | 1/1978 | Japan . | |
| 53-10411 | 3/1978 | Japan . | |
| 53-10410 | 3/1978 | Japan . | |
| 53-13568 | 5/1978 | Japan . | |
| 53-22921 | 7/1978 | Japan . | |
| 53-32090 | 8/1978 | Japan . | |
| 53-48852 | 11/1978 | Japan . | |
| 55-26688 | 7/1980 | Japan . | |
| 56-1389 | 1/1981 | Japan . | |
| 56-21602 | 5/1981 | Japan . | |
| 56-27237 | 6/1981 | Japan . | |
| 56-29736 | 7/1981 | Japan . | |
| 56-42651 | 10/1981 | Japan . | |
| 56-55238 | 12/1981 | Japan . | |
| 57-15178 | 3/1982 | Japan . | |
| 58-5972 | 2/1983 | Japan . | |
| 58-10974 | 2/1983 | Japan . | |

*Primary Examiner*—Henry A. Bennett

*Attorney, Agent, or Firm*—Cushman, Darby & Cushman

[57] ABSTRACT

There is described a fluidized-bed plant, notably for heat-processing metal goods, such as wires, bars, etc., comprising at least one chamber filled partly at least with a powdered material suspended in a gas, and at least one disperser provided adjacent the chamber bottom, wherefrom the gas may be fed and distributed substantially continuously inside said chamber, which further comprises means to retain a gas re-circulation inside the disperser.

20 Claims, 3 Drawing Sheets

FLUIDIZED-BED PLANT

This invention relates to a fluidized-bed plant, notably for heat-processing metal products such as wires, bars, etc., comprising at least one chamber which is partly filled with a powder material suspended in a gas, and at least one disperser provided adjacent the chamber bottom, wherefrom said gas can be fed and substantially continuously dispersed into said chamber.

Head-processing metal objects by means of a fluidized bed is a known technique.

Thus for such a particular use, the fluidized bed operates by means of a gas conveying calories to a suitable powdered material, such as sand which conveys in turn the heat thereof to those objects to be processed.

Heat-conveying to objects to be warmed is a function of various parameters, such as the gas kind and temperature, as well as the kind and particle size of the powdered material and the gas rising speed, the so-called fluidizing speed.

Such gas rising speed should be controlled within relatively narrow limits to obtain a fluidized bed with a regular, stable condition.

Indeed when the speed is too fast, powdered material particles are driven out of the fluidized bed, while when the speed is too slow, the powdered material can not be retained suspended and settles partly at least as a pile, in such a way that heat exchanging between said powdered material and the charge, such as wires to be procesed, becomes susbtantially zero.

On the other hand as the fluidizing gas also comprises a carrier to convey calories between the powdered material and the charge to be processed, the number of calories being conveyed will be dependent on the flow-rate of the gas passing through the fluidized bed.

Consequently, in view of the requirements for the speed and consequently the flow-rate of that gas being used, it is substantially impossible to regulate within relatively wide limits, the number of calories to be conveyed to the charge to be processed in the fluidized bed.

When the temperature being required for the gas is relatively high, there is a danger not to be dismissed, that the disperser will be rapidly damaged.

One object of the invention is to obviate this drawback with relatively simple but very efficient means.

For this purpose, the plant according to the invention comprises means for retaining a gas re-circulation in the disperser.

Advantageously, the disperser comprises at least one tube-like element in the shape of a closed loop which is connected to a source of pressurized gas or gas having some kinetic energy, in such a way that the gas be fed in said loop with a well-determined direction and consequently part of said gas may flow in closed circuit along said direction in the loop, perforations being provided in the tube-like element wall to let the other gas part be dispersed in said chamber.

In a particular embodiment of the invention, said tube-like element is arranged some distance above the chamber bottom, while said perforations are provided on the element lower side and face the bed bottom.

In a preferred embodiment of the invention, to allow regulating calory conveying between said powdered material and the charge to be processed without disturbing the fluidizing, said chamber is of elongated shape and is divided along the lengthwise direction thereof, into at least two succeeding adjacent zones, at least one disperser being provided for each zone, the disperser in one zone being controlled independently from the disperser in the other zone, in such a way that the one said zones may be disabled or fed with another gas, for example with another temperature, without influencing said other zone.

Other details and features of the invention will stand out from the following description, given by way of non limitative example and with reference to the accompanying drawings, in which.

In the various figures, the same reference numerals pertain to identical or similar elements.

The figures show a plant comprised of a fluidized-bed oven for subjecting wires, bars or tubes moving continuously through said bed, to a head processing.

Said oven comprises a chamber 1 partly filled with powdered material 2 suspended in a gas, and a disperser or distributor 3 provided adjacent the chamber bottom 4, wherefrom said gas may be fed and distributed susbtantially continuously into said chamber.

Figure 4:
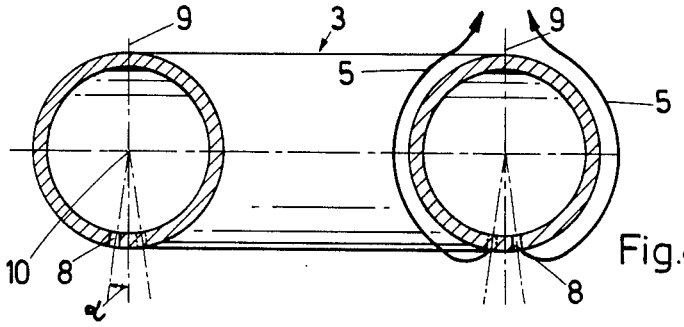
FIG. 4 shows on a larger scale and in section, a detail from said particular embodiment.

In this particular embodiment, the disperser is comprised of a tube-like element in the shape of a closed loop connected to an inner-combustion burner 6, in such a way that the combustion gas therefrom be fed to said loop along a well-determined direction, as shown with arrow 7, and thus part of said gas can flow in closed circuit along said direction in said loop, perforations 8 being provided in the tube-like element wall to let the other gas part be fed and distributed inside chamber 1, as shown with arrows 5 in FIG. 4.

Said tube-like element 3 is arranged some short distance above the bottom 4 of chamber 1, and said perforations 8 are provided on the tube-like element lower side and thus face said chamber bottom 4.

More particularly, the tube-like element 3 has in this embodiment, a circular cross-section and said perforations 8 are distributed substantially uniformly on either side of a vertical plane 9 which goes through the axis 10 of said element 3, as shown clearly in FIG. 4.

Consequently, the gas flowing out of element 3 through said perforations 8 licks on either side of said plane 9, the outer wall of element 3 while cooling same and preventing a powdered material deposit being formed on the top side thereof.

It has been noticed that good results are obtained when said perforations 8 lie at an angular spacing from vertical plane 9 relative to element axis 10 which lies between 5 and 10°, preferably about 7.5°.

Fins 11 slipped over and welded some distance away from one another in vertical planes on said element 3, allow to control accurately the rising gas stream flowing out of said perforations 8 and thus preventing preferred gas paths being formed in said powdered material 2.

For clearness sake, such fins have not been shown in FIG. 4.

It is also of great importance to note that said fins have a good influence on the conveying of heat from disperser 3 to the moving particles from said powdered material 2.

As the oven according to this particular embodiment of the invention is intended for processing long objects such as wires, bars, tubes, etc., said chamber 1 is of tunnel shape and is divided along the lengthwise direction thereof, into a plurality of succeeding adjacent zones, one or a plurality of dispersers 3 being provided in each said zones.

Figure 1:
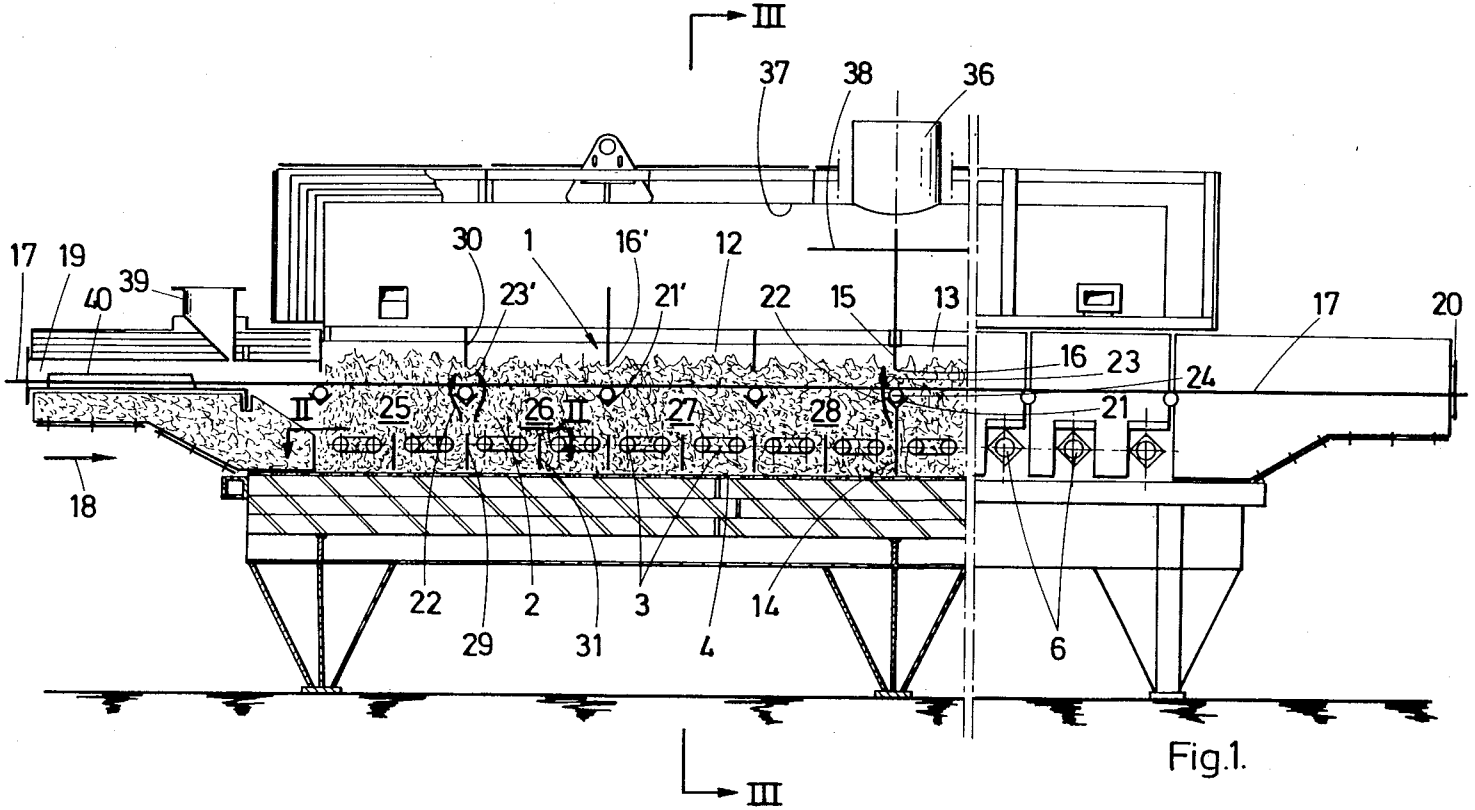
FIG. 1 is a side view with parts broken away, of a particular embodiment of a fluidized-bed plant according to the invention.

FIG. 1 shows a first zone 12 and part of a second adjacent zone 13.

The dispersers in one zone, for example the first zone 12, are controlled independently from the dispersers in the other zones, notably in the second adjacent zone 13, in such a way that it is possible to adapt the total fluidized bed length according to the calories being required and the charge processing through said chamber 1.

In this respect, it is possible either to disable one or a plurality of zones, or to vary the temperature in one zone relative to another zone.

It is thus also possible to change the kind of gas being fed to some particular zone relative to that gas being fed to one or a plurality of other zones.

Advantageously, the adjacent zones are separated from one another by two partition parts 14 and 15, which lie substantially at right angle.

Said part 14 extends in the lowermost part of chamber 1, sidewise relative to dispersers 3, the other part being arranged inside the uppermost part of said chamber 1, in the plane of said part 14, and extending to some depth inside the powdered material 2, when same is not being fluidized.

The opening 16 provided between both said partition parts 14 and 15 is intended to let the charge, notably wires, tubes or bars, pass from the one zone to the following one inside chamber 1.

Figure 2:
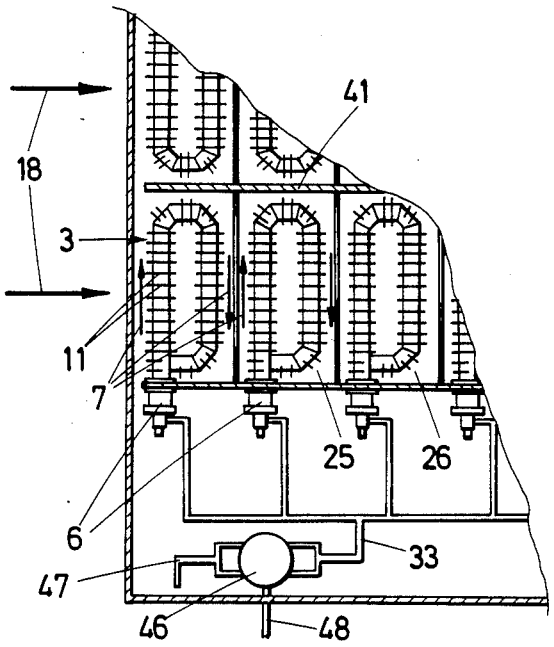
FIG. 2 is a part diagrammatic showing of a section along line II—II in FIG. 1.
Figure 3:
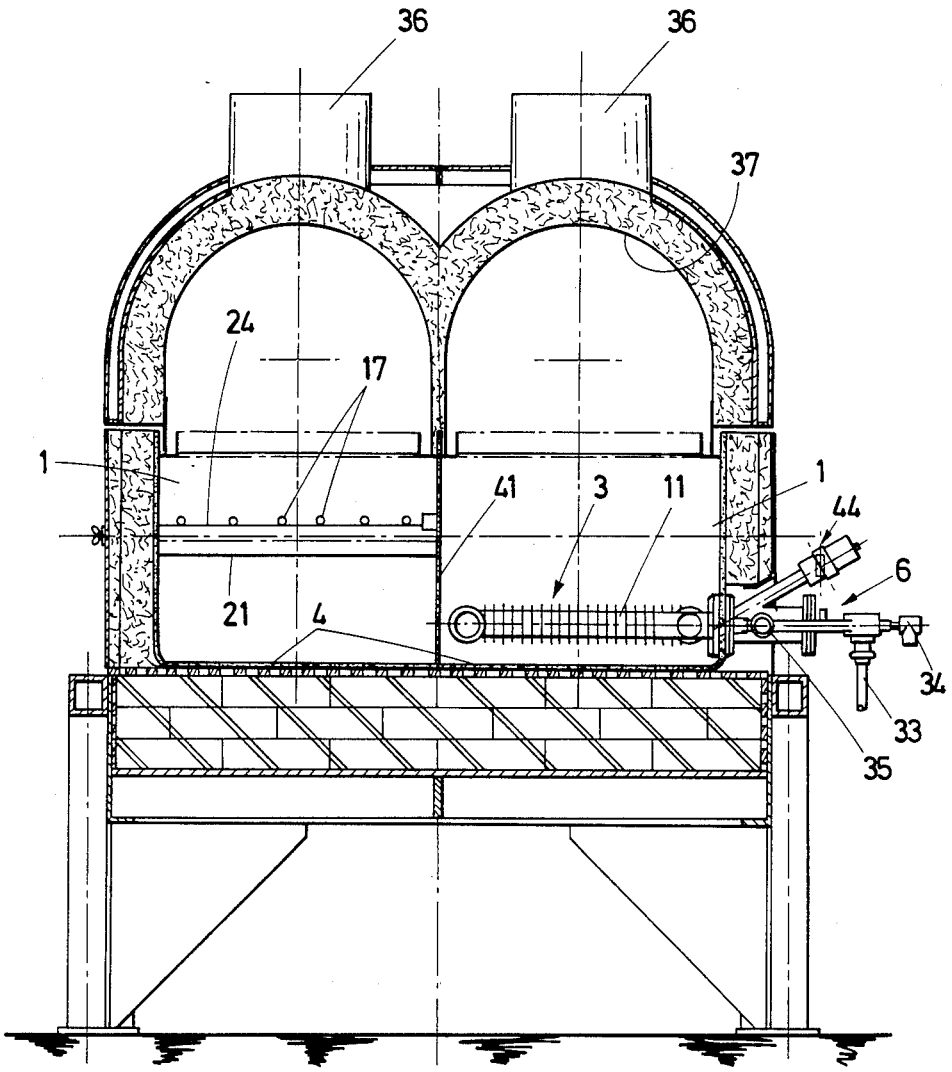
FIG. 3 is a cross-section along lines III—III in FIG. 1.

In the embodiment as shown in FIGS. 1 to 3, said wires, tubes or bars are shown in 17 and move as a substantially horizontal sheet some distance away from one another along the direction of arrow 18 through said chamber 1, along the lengthwise direction thereof.

Said chamber 1 is provided sidewise at the the one end thereof, with an inlet 19 for said wires, tubes or bars 17, which lies somewhat below the level of said powdered material 2 when same is in a non-fluidized condition, and with an outlet 20 at the opposite end of said chamber 1, substantially at the same level as inlet 19.

When required, both inlet 19 and outlet 20 may be closed with a non-fluidized powdered material plug, for example to minimize as far as possible the heat losses.

Inside the opening 16 between partition parts 14 and 15, underneath that location where the wires, tubes or bars 17 pass, V-shaped baffles 21 are provided, which allow diverting the rising gas stream from said dispersers 3, as shown with arrows 22. This results in forming above said baffles, a plug 23 from powdered material which is slightly or not fluidized, wherethrough said wires, tubes or bars can move.

As shown in FIG. 1, as said wires, bars or tubes 17 pass through opening 16, they bear on a fixed cylinder-shaped bearing 24 against the lower side of which said baffles 21 are secured.

Consequently, the plug may advantageously form on said bearing 24.

To insure as efficient as possible a separation betwen two adjacent zones 12 and 13, the lowermost partition part 14 extends from chamber bottom 4 to baffles 21.

The zones may in turn also be divided into cross-wise compartments relative to the lengthwise axis of said chamber 1.

In the embodiment as shown in FIG. 1, the first zone 12 is divided into four compartments 25, 26, 27, 28.

Two succeeding compartments are separated from one another by partition portions 29 and 30, somewhat similar to partition portions 14 and 15 separating succeeding zones 12 and 13.

In the embodiment as shown, the only difference lies in the separation between two succeeding compartments being formed in the lowermost part of chamber 1, by a partition portion 29, which ends some distance away from baffles 21′ provided in the passage opening 16′ between two succeeding compartments and whereabove are also provided bearings 24′ for the wires, bars or tubes 17.

This thus results as it is the case for the separation between two succeeding zones 12 and 13, in a similar plug 23′ may form between two succeeding compartments.

Still with the purpose of controlling, directing and distributing substantially uniformly the rising gas stream in the shape of a regular bubble sequence, thoroughly mixed with the powdered material 2 retained suspended and moving, it may be useful to provide sidewise guide plates on either side of disperser 3.

In FIG. 1, two dispersers are provided per compartment, separated from one another by a guide plate 31 and having on the opposite side, as guide plate, partition portions 29 separating two succeeding compartments from one another.

In the last compartment, the one guide plate is thus formed by partition part 14.

When considering the unit formed by fins 11 and guide plates 31, some of which are comprised of partition portions 14 and 29, there is noted that the lowermost part of chamber 1 has actually level with the dispersers 3, over the whole bottom surface, vertical side-by-side imaginary ducts in each one of which there is formed a substantially homogeneous rising stream of gas bubbles retaining the powdered material suspended and stirred inside chamber 1.

Still in the embodiment as shown in the figures, the burners 6 which supply separately each said dispersers 3, are burners fed by means of mixers 32 providing a combustive air-combustible gas ratio which is independent from the flow-rate, in such a way that controlling the gas mixture fed to the burner is being insured whatever be the operating condition of said fluidized bed.

As shown in FIGS. 2 and 3, the mixture of combustive gas such as air, and combustible gas is supplied through line 33. Such mixing is made with suitable proportions inside a mixer 46 whereto an air supply 47 and a gas supply 48 are connected.

Firing the burner 6 occurs by means of an electrode 34, while an UV sensor 44 is provided for controlling the flame presence.

It is further possible to consider providing for diluting the combustion gas flowing out of the burner and being fed to the disperser 3 with a relatively cold gas which thus allows to adjust the flow-rate and the temperature of the gas inside disperser 3. Such supply may for example be formed by a line 35 opening downstream of the outlet from burner 6.

Along the same line of thoughts, said dilution gas may be comprised of gas being discharged from the fluidized bed.

This may be obtained for example by deflecting part of the gas being discharged through a flue 36 provided above chamber 1 and returned to the burner outlet by a line not shown in the figures.

Other possibilities lie in using a heat exchanger, not shown, arranged below the oven crown 37, in the gas discharge stream to flue 36, wherewith both the combustive air and the diluting air might be warmed.

To prevent particles from that powdered material comprising the fluidized bed, being carried away, retaining plates 38 may be located upstream of the flue 36, thus allowing to form a zigzag path for the gas flowing thereto.

Finally powdered material which would be carried along by the wires, bars or tubes 17 moving through chamber 1, might be recovered at the outlet 20 from chamber 1 and be returned to a hopper 39 provided at the inlet 19 to the chamber.

To retain said wires, bars or tubes 17 spaced by a susbtantially constant and regular distance from one another as they run through chamber 1, they might be guided in a comb 40 arranged in inlet 19.

In the embodiment as shown in FIGS. 1 to 4, the oven comprises two chambers 1 lying in parallel relationship next to one another along the oven lengthwise axis. Both said chambers 1 are separated from one another by a partition 41.

As it thus appears clearly from FIGS. 2 and 3, both said chambers are substantially identical and each comprise an identical number compartments, zones and dispersers.

This is actually a twin oven.

It is thus possible in said oven to pass wires, bars or tubes simultaneously in both side-by-side chambers, or in the one chamber, or else it is possible to act differently on the fluidized beds inside each said chambers.

Figure 5:
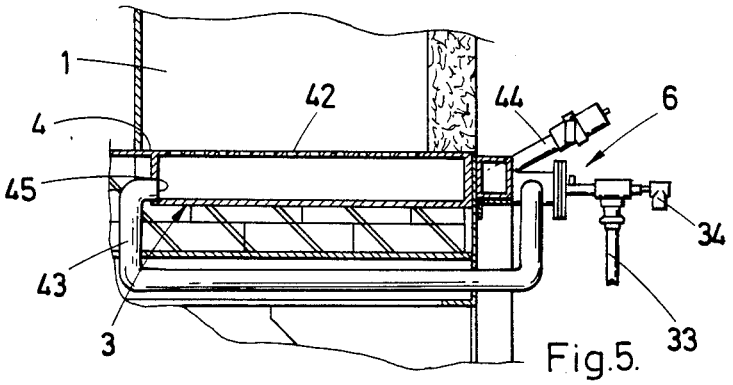
FIG. 5 is a part diagrammatic showing in cross-section of a variation of fluidized-bed plant according to the invention.

FIG. 5 diagrammatically shows a cross-section at right angle to the axis of a fluidized-bed plant according to another embodiment of the invention.

Said plant essentially differs from the one as shown in FIGS. 1 to 4 by the disperser 3 being comprised of a box arranged underneath the bottom 4 of chamber 1 and separated therefrom by means of a grate 42 embedded in said bottom 4. Said box communicates on the one side with a source of pressurized gas or gas having some kinetic energy, such as the outlet opening from a burner 6, the opposite side of said box 3 having an outlet 45 to a re-circulation line 43 connected in that location where the gas source communicates with the box.

It is thus possible according to the invention, to sustain a constant re-circulating of part of the gas inside the disperser, while another gas part goes through grate 42 to raise and stir the powdered material 2 inside chamber 1.

Such re-circulation allows in a substantially unexpected way, as also in that disperser as shown in figure 3, to retain the wall temperature thereof below some limits.

Means may be provided to regulate the re-circulation flow-rate, more particularly the ratio between said flow-rate and the gas flow-rate through grate 42. Such means may for example be comprised of a valve, not shown in figure 5, allowing to vary the cross-section of outlet opening 45. Said means may also comprise a system to regulate the passage cross-section through the grate, notably the cross-section or number of open openings from said grate.

When it is desired to control the fluidized bed volume, it is possible to provide a plurality of separate boxes lying next to one another underneath the bottom of chamber 1, each said boxes being fed from a different independent gas source, thus in such a way as to exert substantially the same control on the fluidized bed as with the disperser embodiment according to FIGS. 1 to 4.

Generally the ratio between the gas being re-circulated within disperser 3 and the gas being fed to chamber 1 may vary within very wide limits. Very good results have however been obtained with a gas re-circulation lying between 75 and 95% of the total flow-rate.

To further illustrate the patent application object, there is given hereinafter an actual embodiment example of wire annealing processing inside an oven as shown in figures 1 to 4, which comprises four succeeding zones, each divided into four compartments.

Characteristics
Wire number: 24 (soft steel)
Wire diameter: 1.6 to 6.35 mm
Spacing between 2 wires: 38 mm
Wire sheet width: 876 mm
Wire speed: dV=90
Maximum speed: 56 m/min.
Maximum throughput: 2000 kg/h
Dipped wire length: 10 m
Inner width: 1 m
Inner height: 860 mm
Number of heating zones: 4
Number of burners per zone: 16
Fitted power: 528,000 Kcal/h
Bath temperature: 1st zone: 550°, 2nd zone: 695°, 3rd zone : 782°, 4th zone: 680°
Powdered material characteristics:
granulometry: 90 to 125 microns
analysis: fire loss: 0.20%
$SiO_2$: 99%
$Fe_2O_3$: ±0.05%
$TiO_2$: ±0.06%
CaO: ±0.03%
$Na_2O+K_2O$: ±0.04%

It must be understood that the invention is in no way limited to the above embodiments and that many changes may be brought thereto without departing from the scope of the invention as defined by the appended claims.

For instance, the plant might also be designed for cooling or chemically processing any kind of object.

It may thus be a matter of a plant with discontinuous fluidized bed, even of course when a marked preference should be given to continuous-processing plants.

The plant according to the invention is particularly suitable for replacing lead baths, as used presently for processing wires, and notably for quenching and annealing wires, such processing requiring succeeding heating and cooling zones.

I claim:

1. Fluidized-bed plant, notably for heat-processing metal goods, such as wires, bars, or the like, comprising at least one chamber filled partly at least with a powdered material suspended in a gas, and at least one disperser provided adjacent the chamber bottom, wherefrom the gas may be fed and distributed substantially continuously inside said chamber, which said disperser comprises means to effect a gas recirculation of part of the gas inside the disperser, while another part of the gas forms the gas fed and distributed inside said chamber.

2. Plant as defined in claim 1, in which said disperser comprises at least one tube-like element in the shape of a closed loop, connected to a source of pressurized gas or a gas having some kinetic energy, in such a way that the gas be fed to said loop along a well-determined direction and thus part of said gas may flow in closed circuit along said direction in said loop, perforations being provided in the tube-like element wall to let the other gas part be distributed into said chamber.

3. Plant as defined in claim 2, in which said tube-like element is arranged a distance above the chamber bottom, while said perforations are provided on the element lower side, facing said bottom.

4. Plant as defined in claim 3, in which at least said lower side of the tube-like element has a cross-section in the shape of an arc of circle, said perforations being distributed substantially uniformly on either side of a vertical plane passing through the tube-like element axis.

5. Plant as defined in claim 4, in which said perforations lie at an angular spacing from said vertical plane relative to the element axis, lying between 5° and 10°, preferably about 7.5°.

6. Plant as defined in claim 2, in which fins extending substantially in vertical planes, are provided on the outer side of said tube-like element.

7. A fluidized-bed plant, notably for heat-processing metal goods, such as wires, bars and the like, comprising at least one chamber filled partly at least with a powdered material suspended in a gas, and at least one disperser provided adjacent the chamber bottom, from which the gas may be fed and distributed substantially continuously inside said chamber, and said disperser further comprising means to effect a gas re-circulation inside said disperser, said chamber having an elongated shape and being divided along the length-wise direction thereof, into at least two succeeding adjacent zones, at least one disperser being provided in each said zone, a said disperser from one zone being controlled independently from a said disperser in another zone, in such a way that gas may be selectively fed to one zone at a selected temperature without affecting another zone.

8. Plant as defined in claim 7, in which said zones are separated from one another by two partition parts substantially at right angle, the one partition part extending into the chamber lowermost part, sidewise relative to the disperser, the other partition part extending into the chamber uppermost part, substantially in the plane of the first partition part, down to some depth in the powdered material when said material is not being fluidized, the opening provided between both said parts being intended to let the charge pass from one zone to the adjacent zone.

9. Plant as defined in claim 8, in which baffles are provided in said opening, underneath that location for the charge passage, allowing to deflect partly at least the rising gas stream from the disperser, and to thus form above said baffles, a plug from slightly or un-fluidized powdered material, wherethrough the charge can move.

10. Plant as defined in claim 9, in which bearings for the charge are arranged above the baffles.

11. Plant as defined in claim 9, in which the first partition part extends from the chamber bottom substantially up to said baffles.

12. Plant as defined in claim 7, in which at least one zone is divided into cross-wise compartments relative to the chamber lengthwise axis.

13. Plant as defined in claim 2, in which said gas source is comprised of a burner generating hot gases, notably a burner fed with a pre-mixture of combustive gas and combustible gas.

14. Plant as defined in claim 13, in which the gas source further comprises an inlet for relatively cold gas, thus allowing to regulate the gas flow-rate and temperature inside the disperser.

15. Plant as defined in claim 14, in which said gas source comprises an inlet for gas being discharged from the fluidized bed.

16. Plant as defined in claim 1, which further comprises an inlet for the charge at the one chamber end lying somewhat below the powdered material level, when said material is not being fluidized, and an outlet at the opposite chamber end, substantially level with said inlet, said inlet and outlet may be closed by a plug from un-fluidized powdered material.

17. Plant as defined in claim 16, in which means are provided to cycle back to the inlet, powdered material which is carried along and/or recovered at the chamber outlet.

18. Plant as defined in claim 1 or claim 7, in which said disperser comprises a box arranged in said chamber bottom and communicating therewith through a grate wherethrough the gas enters said chamber, said box communicating on a sidewise side with a gas source, and having on the opposite side, an outlet through a re-circulation line to said gas source, means being provided to regulate the ratio of the flow-rate of that gas passing through the grate, to the re-circulated gas flow-rate.

19. Plant as defined in claim 7, in which said disperser comprises a box arranged in said chamber bottom and communicating therewith through a grate wherethrough the gas enters said chamber, said box communicating on a sidewise side with a gas source, and having on the opposite side, an outlet through a re-circulation line to said gas source, means being provided to regulate the ratio of the flow-rate of the gas passing through the grate, to the re-circulated gas flow rate.

20. A fluidized-bed plant, notably for heat-processing metal goods, such as wires, bars and the like, comprising at least one chamber filled partly at least with a powdered material suspended in a gas, and at least one disperser provided adjacent the chamber bottom, from which the gas may be fed and distributed substantially continuously inside said chamber, and said disperser further comprising means to effect a gas re-circulation inside said disperser, said disperser comprising at least one tube-like element in the shape of a closed loop, connected to a source of pressurized gas, in such a way that the gas will be fed to said loop along a well-determined direction and thus part of said gas will flow in a closed circuit along said direction in said loop, perforations being provided in the tube-like element wall to allow the other gas part to be distributed into said chamber, said disperser being located between two substantially vertical guide plates allowing upward direction of the gas and throttling of the gas stream from the disperser.

* * * * *